US008131196B2

(12) United States Patent
Suzuki

(10) Patent No.: US 8,131,196 B2
(45) Date of Patent: Mar. 6, 2012

(54) IMAGE FORMING APPARATUS HAVING A TRANSFERRING MEMBER

(75) Inventor: Akimichi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 773 days.

(21) Appl. No.: 11/908,359

(22) PCT Filed: Apr. 24, 2006

(86) PCT No.: PCT/JP2006/309065

§ 371 (c)(1),
(2), (4) Date: Sep. 11, 2007

(87) PCT Pub. No.: WO2006/115294

PCT Pub. Date: Nov. 2, 2006

(65) Prior Publication Data

US 2009/0010675 A1 Jan. 8, 2009

(30) Foreign Application Priority Data

Apr. 25, 2005 (JP) ..... 2005-126454

(51) Int. Cl.
*G03G 15/16* (2006.01)

(52) U.S. Cl. ..... 399/308; 399/101; 399/316

(58) Field of Classification Search ..... 399/302, 399/308, 101, 316
See application file for complete search history.

(56) References Cited

U.S. PATENT DOCUMENTS 5,665,444 A * 9/1997 Eguchi et al.
(Continued)

FOREIGN PATENT DOCUMENTS

JP 2-244177 A 9/1990
(Continued)

OTHER PUBLICATIONS

Russian Office Action mailed Nov. 25, 2008 in Russian Application No. 2007143535/(047700), with English-language translation.

(Continued)

*Primary Examiner* — Susan Lee
(74) *Attorney, Agent, or Firm* — Fitzpatrick, Cella, Harper & Scinto

(57) ABSTRACT

The image forming apparatus has a configuration in which a secondary transfer roller guides a leading end of a recording material which enters a secondary transfer nip to be led to the secondary transfer nip and the leading end of the recording material is prevented from coming into contact with a toner image on an intermediate transferring member before the recording material enters the secondary transfer nip. Further, in the image forming apparatus, a surface of a transfer roller is smoothened so that the leading end of the recording material is guided to the secondary transfer nip without being caught. As a result, the present invention is intended to prevent the leading end of the recording material which enters the secondary transfer nip from distorting the toner image on the intermediate transferring member.

14 Claims, 5 Drawing Sheets

U.S. PATENT DOCUMENTS

| | | | | |
|---|---|---|---|---|
| 5,742,888 | A * | 4/1998 | Fuchiwaki et al. | 399/308 |
| 5,991,590 | A * | 11/1999 | Chang et al. | 399/302 |
| 6,175,711 | B1 | 1/2001 | Yoshino et al. | |
| 6,516,179 | B1 | 2/2003 | Sawai et al. | |
| 6,829,449 | B2 | 12/2004 | Matsumoto et al. | |
| 7,099,615 | B2 * | 8/2006 | Izumi | 399/316 |
| 2001/0019674 | A1 | 9/2001 | Asano et al. | |
| 2003/0113141 | A1 | 6/2003 | Saito et al. | |
| 2004/0170457 | A1 * | 9/2004 | Kamimura et al. | |
| 2006/0083559 | A1 * | 4/2006 | Yoo et al. | 399/316 |
| 2008/0019717 | A1 * | 1/2008 | Soshiroda | 399/308 |

FOREIGN PATENT DOCUMENTS

| | | | |
|---|---|---|---|
| JP | 9-090780 | A | 4/1997 |
| JP | 09171309 | A * | 6/1997 |
| JP | 11-065332 | A | 3/1999 |
| JP | 2000-187405 | A | 7/2000 |
| JP | 2001-356538 | A | 12/2001 |
| JP | 2002-132070 | A | 5/2002 |
| JP | 3470472 | B2 | 11/2003 |
| JP | 2004-45457 | A | 2/2004 |
| JP | 2004-109354 | A | 4/2004 |
| JP | 2004-115266 | A | 4/2004 |
| JP | 2004-333907 | A | 11/2004 |

OTHER PUBLICATIONS

Japanese Office Action mailed Mar. 7, 2008 in Application No. 2006-112235, with English-language translation.

Written Opinion and International Search Report in International Application No. PCT/JP2006/309065.

First Examination Report, dated Jun. 15, 2011, in Indian Application No. 5354/CHENP/2007.

* cited by examiner

IMAGE FORMING APPARATUS HAVING A TRANSFERRING MEMBER

TECHNICAL FIELD

The present invention relates to an image forming apparatus which transfers a toner image borne on an image bearing member onto a recording material.

BACKGROUND ART

As a conventional electrophotographic technology, there is a technology which inserts a recording material between an image bearing member bearing a toner image thereon and a transfer roller and transfers the toner image on the image bearing member onto the recording material.

In this technology, U.S. Pat. No. 6,516,179 discloses how a recording material enters a transfer nip. An image forming apparatus described in this U.S. Pat. No. 6,516,179 has a guide member which guides the recording material toward a secondary transfer nip portion of an intermediate transfer belt. A leading end of the recording material is first brought into contact with the intermediate transfer belt by this guide member so that the recording material advances toward the secondary transfer nip along the intermediate transfer belt.

However, an advancing method of the recording material toward the secondary transfer nip such as one in the image forming apparatus in U.S. Pat. No. 6,516,179 may produce a phenomenon that the leading end portion of the recording material removes a toner image on the intermediate transfer belt in some cases. Further, removal of the toner image by the leading end portion of the recording material generates an image deficit. This image deficit hardly occurs when a sufficient margin is assured at an edge on the leading end side of the recording material, but this image deficit remarkably appears when a margin is small or when an image without a margin is formed.

DISCLOSURE OF THE INVENTION

An object of the present invention is to suppress a leading end of a recording material from removing a toner image on a toner image bearing member, thereby avoiding a deficit of the toner image.

Another object of the present invention is to provide an image forming apparatus which sets a leading end of a recording medium along a transfer roller to advance the recording material into a nip formed of a toner image bearing member and the transfer roller.

A further object of the present invention is to provide an image forming apparatus comprising: an image bearing member which bears a toner image; and a transferring member which forms and a nip with said image bearing member and transfers the toner image onto a recording material which enters the nip; and a guide member which guides a leading edge of the recording material to be brought into contact with a surface of said transferring member before the leading edge of the recording material enters the nip, wherein said transferring member has a foamed layer and a cover layer, and said cover layer is not foamed and constitutes the surface of said transferring member.

A further object of the present invention is to provide an image forming apparatus comprising an image bearing member which bears a toner image a transfer roller which forms a nip with said image bearing member and transfers the toner image onto a recording material which enters the nip and a guide member which guides a leading edge of the recording material to be brought into contact with said transferring member before the leading edge of the recording material enters the nip, wherein said transfer roller guides the leading edge of the recording material to the nip, said transfer roller having a layer foamed of a cellular material having not opened cells in contact with the recording medium.

A further object of the present invention is to provide an image forming apparatus comprising an image bearing member which bears a toner image a transferring member which forms a nip with said image bearing member and transfers the toner image onto a recording material which enters the nip a transfer opposed member which is provided to said image bearing member on an opposed side of said transferring member and forms a transfer electric field between itself and said transferring member and a guide member which guides a leading edge of the recording material to be brought into contact with said transferring member before the leading edge of the recording material enters the nip, wherein, in a recording material moving direction, an uppermost position of the nip is closer to an upstream side than an uppermost position of a region in which said transfer opposed member comes into contact with said image bearing member.

A further object of the present invention is to provide an image forming apparatus comprising an image bearing member which bears a toner image an intermediate transferring member which receives transfer of the toner image from said image bearing member a transferring member which forms a nip with said intermediate transferring member and transfers the toner image onto a recording material which enters the nip and a guide member which guides a leading edge of the recording material to be brought into contact with said transferring member before the leading edge of the recording material enters the nip, wherein a surface of said transferring member with which the leading edge of the recording material comes into contact is coated with a fluorine compound.

A further object of the present invention is to provide an image forming apparatus comprising an image bearing member which bears a toner image an intermediate transferring member which receives transfer of the toner image from said image bearing member; a transferring member which forms a nip with said intermediate transferring member and transfers the toner image onto a recording material which enters the nip and a guide member which guides a leading edge of the recording material to be brought into contact with said transferring member before the leading edge of the recording material enters the nip, wherein a surface of said transferring member with which the leading edge of the recording material comes into contact is coated with a siloxane compound.

A further object of the present invention is to provide an image forming apparatus comprising an image bearing member which bears a toner image a transferring member which forms a nip with said image bearing member and transfers the toner image onto a recording material guided to be brought into contact with a surface of said transferring member before the leading edge of the recording material enters the nip, wherein an image without a margin at the leading edge of the recording material is formed on the recording material.

A still further objects of the present invention will become clear by the following description and the accompany drawings.

BEST MODE FOR CARRYING OUT THE INVENTION

An image forming apparatus according to the present invention will now be described in detail hereinafter with reference to the accompanying drawings.

First Embodiment

A preferred embodiment according to the present invention will now be described hereinafter in detail with reference to the accompanying drawings. However, dimensions, materials, shapes, relative arrangements and others of constituent components described in the following embodiment should be appropriately changed based on a configuration or various kinds of conditions of an apparatus to which the present invention is applied, and a scope of the present invention is not restricted thereto unless a specific description is given in particular.

Figure 1:
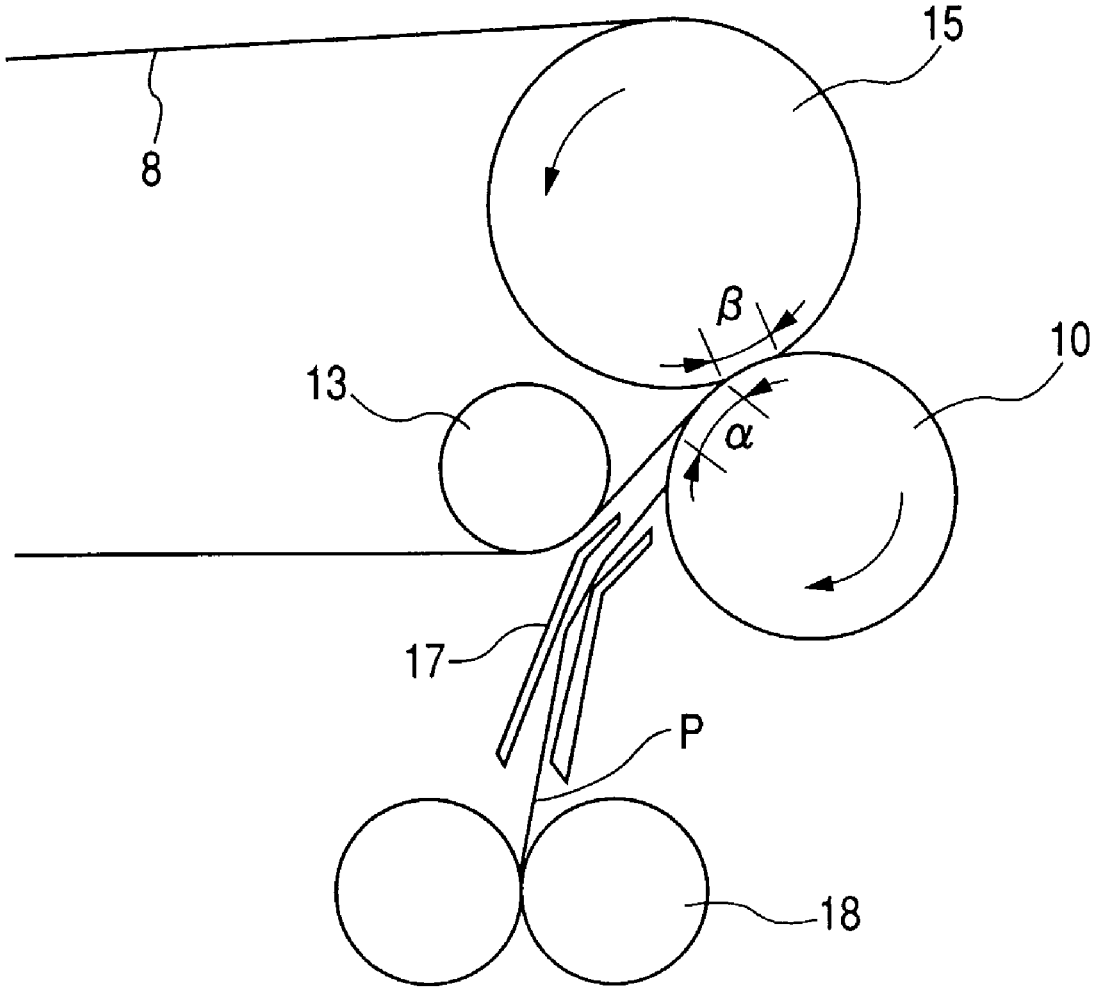
FIG. 1 shows an outline configuration of a secondary transfer portion of an image forming apparatus according to a first embodiment of the present invention.
Figure 2:
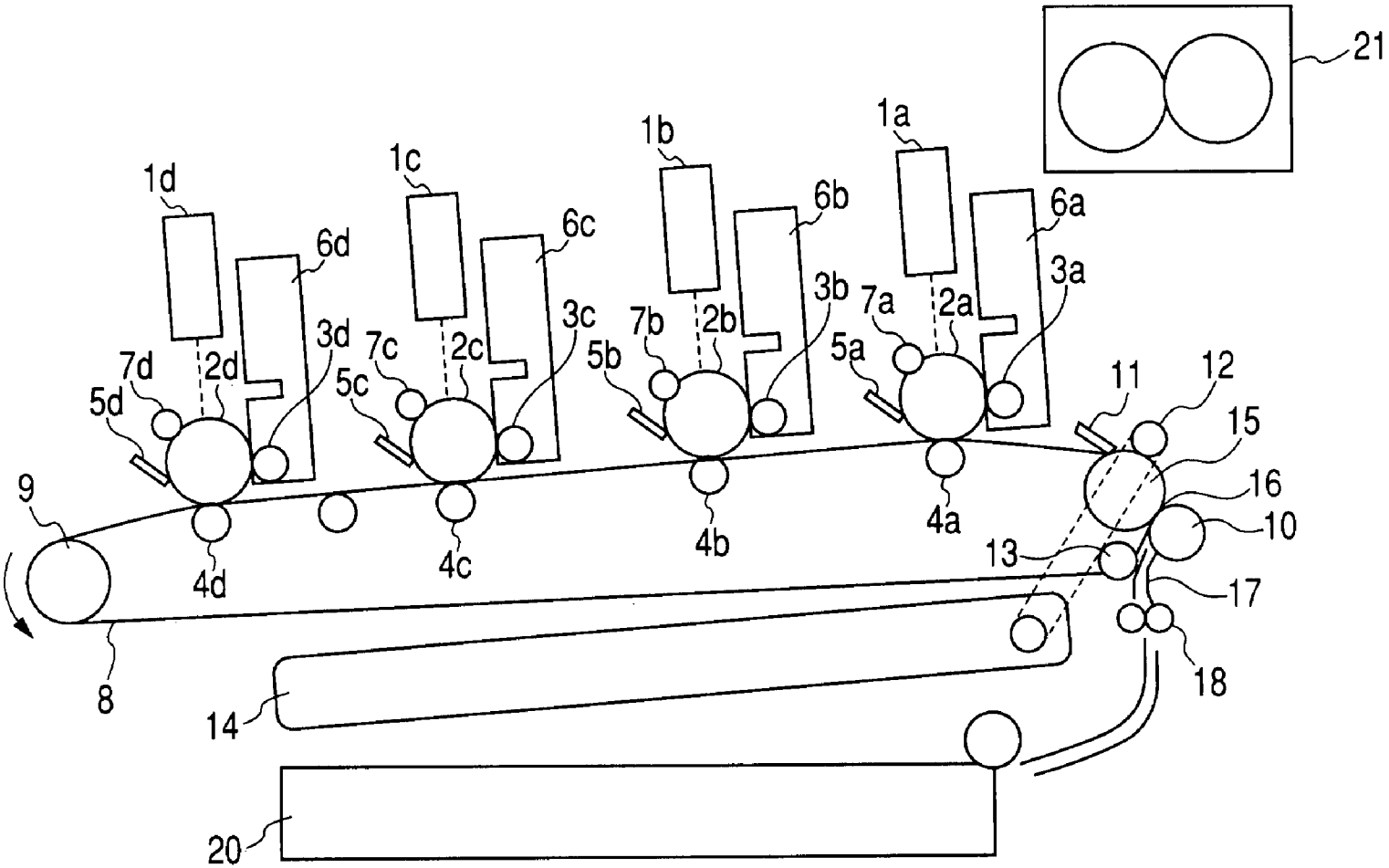
FIG. 2 shows an outline configuration of the image forming apparatus according to the first embodiment of the present invention.

A description will be given as to an image forming apparatus according to a first embodiment of the present invention with reference to FIGS. 1, 2, 3 and 4. FIG. 2 is an outline configuration of a color image forming apparatus using an intermediate transfer mode according to the first embodiment.

In the color image forming apparatus adopting the intermediate transfer mode shown in FIG. 2, toner images having various colors are formed on respective photosensitive rollers 2 in a plurality of image forming portions. The plurality of image forming parts are arranged to be aligned along an intermediate transfer belt (an intermediate transferring member) 8 as an endless belt member. The intermediate transfer belt 8 functions as an image bearing member which bears transfer of a toner image.

The image forming portions for respective colors have the photosensitive drums 2 (2*a*, 2*b*, 2*c* and 2*d*) as image bearing members. A charge roller 7 (7*a*, 7*b*, 7*c* or 7*d*) as a primary charge member, an exposure device 1 (1*a*, 1*b*, 1*c* or 1*d*), a developing device 3 (3*a*, 3*b*, 3*c* or 3*d*) constituting developing means, and a photosensitive drum cleaning blade 5 (5*a*, 5*b*, 5*c* or 5*d*) are arranged as means for forming a toner image around each photosensitive member 2. A toner cartridge 6 (6*a*, 6*b*, 6*c* or 6*d*) of each color is accommodated in each development device 3.

A primary transfer roller 4 (4*a*, 4*b*, 4*c* or 4*d*) covered with an elastic member such as foamed rubber on a surface thereof is in contact with a lower portion of each photosensitive drum 2 through the intermediate transfer belt 8, thereby forming a primary transfer portion which transfers a toner image formed on each photosensitive member 2 onto the intermediate transfer belt 8. Therefore, toner images of respective colors formed on the respective photosensitive members 2 are superposed in an order onto the intermediate transfer belt (the intermediate transferring member) 8 by the primary transfer rollers 4 in the respective primary transfer portion (the transfer process is called "primary transfer").

Further, the toner images superimposed on the intermediate transfer belt 8 are collectively transferred onto a recording material P by a secondary transfer roller 10 as a transferring member which is in contact with the intermediate transfer belt 8 to constitute a transfer region. The recording material P is fed from a feeding cassette 20 one by one, and carried to regions α and β formed of the secondary roller 10 and the intermediate transfer belt 8 by a pre-secondary-transfer carriage roller 18 as a recording material carriage portion. During carriage of the recording material P, the recording material P is guided by a pre-transfer guide 17 as a guide member, and the recording material P is stably carried to the regions α and β. This pre-transfer guide 17 guides a leading end of the recording material P to be come into contact with the secondary transfer roller 10 before entering the region α. Furthermore, the recording material which has passed through the regions α and β is pressed and heated by a fixer 21, thereby fixing the transferred toner images on the recording material. On the other hand, a toner remaining on the intermediate transfer belt 8 after secondary transfer is removed from the intermediate transfer belt 8 by a cleaning blade 11. The removed toner is supplied to and stored in a wasted toner container 14 by a wasted toner supply mechanism 12.

Here, a description will be given as to dimensions or materials of main members constituting the secondary-transfer portion, e.g., the intermediate transfer belt 8 or the secondary transfer roller 10.

The intermediate transfer belt 8 is tensioned by a secondary transfer opposed roller 15, a tension roller 9 and a pre-secondary-transfer tension roller 13 as secondary transfer inside members. The intermediate transfer belt 8 is an endless (seamless) single-layer resin belt having a thickness of 75 μm, a circumferential length of 1115 mm and a longitudinal length (an image forming width direction) of 310 mm. An electric resistance of this intermediate transfer belt 8 is adjusted by dispersing carbon in a polyimide material which is a main material of the belt. This intermediate, transfer belt 8 has a volume resistivity of $10^9$ Ω·cm and a surface resistance of $10^{12}$ Ω/cm$^2$ or above as a result of measurement using an ultra high resistance meter R8340 (a registered trademark) manufactured by Advantest. A method of measuring the volume resistivity of this intermediate transfer belt 8 was carried out based on Japanese Industrial Standards "Testing methods for thermosetting plastics (JIS-K6911)". Measurement was performed with electroconductive rubber having a low resistance value being sandwiched between an electrode for measurement and a surface of the belt 8. This configuration stabilizes contact properties between the electrode and the intermediate transfer belt 8. Moreover, measurement was conducted under conditions of 100 V as the volume resistivity of the intermediate transferring member belt 8 and 10 seconds as an application time. It is to be noted that the same measurement value was obtained from measurement on both front and rear surfaces of the intermediate transfer belt 8.

The secondary transfer opposed roller 15 is a roller which tensions the intermediate transfer belt 8 and has a function as an opposed roller of the secondary transfer roller 10 and a function as a driving roller. Additionally, the secondary transfer opposed roller 15 is grounded so that a transfer electric field can be formed between itself and the secondary transfer roller 10. The secondary transfer opposed roller 15 is obtained by coating a cored bar having a diameter of 30 mm with ethylene-propylene-diene (EPDM) rubber whose resistance is adjusted by carbon black and which has a thickness of 500 μm.

The tension roller 9 is an aluminum hollow tube having a diameter of 30 mm, has springs at bearing portions at both ends thereof, and tensions the belt with a total pressure of 40 N. The pre-secondary-transfer tension roller 13 is a stainless roller having a diameter of 14 mm, and rotates in accordance with the intermediate transfer belt 8.

Figure 3:
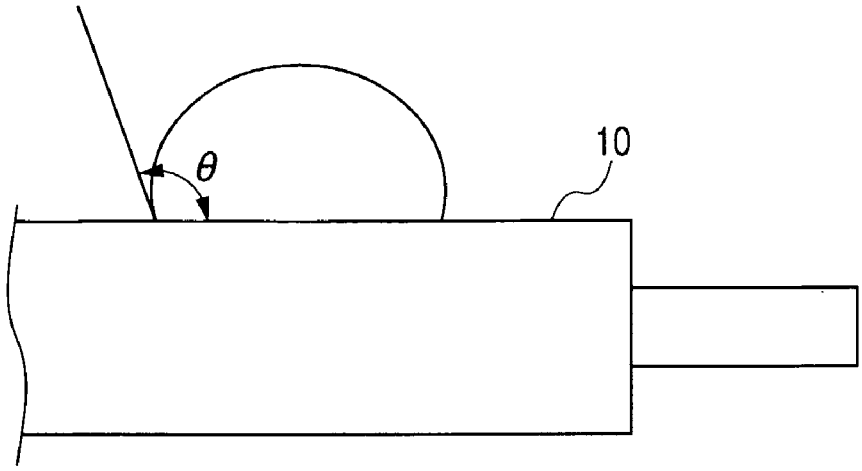
FIG. 3 shows a contact angle (θ) of pure water on a transfer roller surface.
Figure 4:
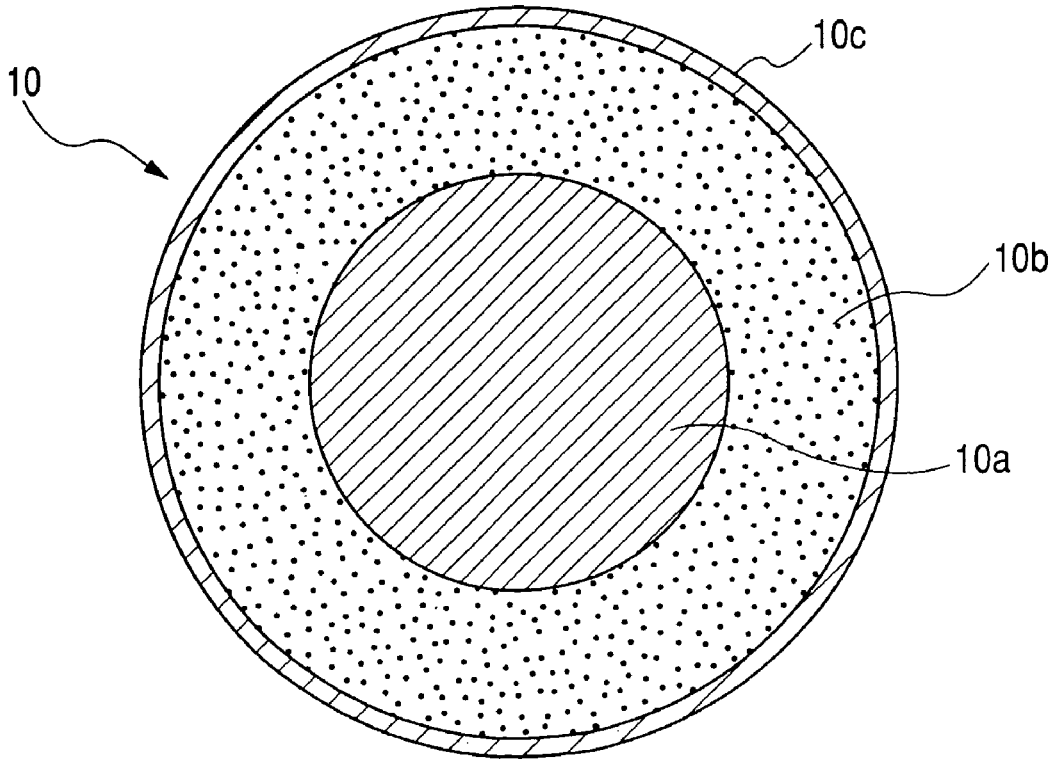
FIGS. 4A and 4B show outline configurations of a secondary transfer portion of an image forming apparatus according to first and second embodiments of the present invention.
Figure 4A:
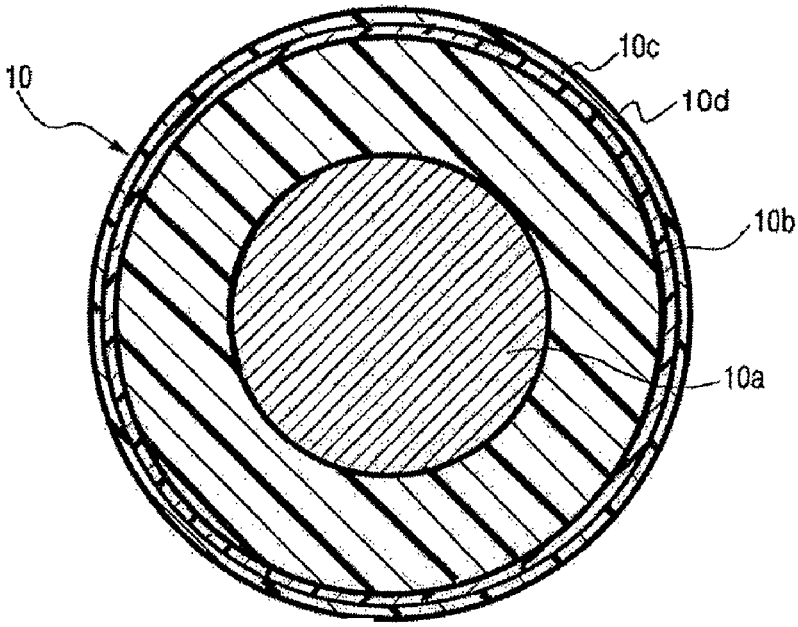

The secondary transfer roller 10 is a roller constituting three layers with respect to a cored bar having a diameter of 12 mm. FIG. 4A shows its cross section. A cored bar 10*a* is coated with foamed hydrin rubber having a thickness of approximately 4 mm from the cored bar side in such a manner that an elastic member (an elastic layer 10*b*) has a diameter of 20 mm over 310 mm, and solid hydrin rubber having a thickness of approximately 1 mm is further superimposed thereon (a cover layer 10*c*). Furthermore, a surface of the layered structure is coated with urethane 10*d* having powdery polyvinylidene fluoride (PVDF) of approximately 20 microns dispersed therein. The surface of the secondary transfer roller 10 is smoothened by this layered structure and coating. This surface of the secondary transfer roller 10 is so smooth that an edge of the recording material P can slide thereon even if the edge comes into contact with this surface. When a surface nature of this secondary transfer roller 10 was measured in terms of a contact angle using pure water, the contact angle θ was 100° . Even though the surface was contaminated due to duration, the contact angle of 60° or above was assured. In a method of measuring the contact angle θ of this secondary transfer roller 10, pure water of approximately 3 ml was dropped onto the surface of the secondary transfer roller, and the contact angle at a contact point of pure water and the secondary transfer roller was measured by using a microscope. FIG. 3 shows a definition of the contact angle θ. It is to be noted that a contact angle meter which is a CA-X type manufactured by Kyowa Interface Science Co., Ltd. was used for measurement. Moreover, a degree of hardness of the secondary transfer roller 10 is 35° in terms of Asker-C hardness in a state where a load of 500 g is applied. It is preferable for the secondary transfer roller 10 to have the Asker-C hardness which is not greater than 45° . That is because the regions α and β can be assuredly formed and stable carriage of the recording material P can be realized when this hardness is adopted.

It is to be noted that a so-called actual resistance value of the secondary transfer roller 10 is $10^7\Omega$. In a method of measuring this resistance value, the value was obtained as a result of measurement using an ultra high resistance meter R8340 (a registered trademark) manufactured by Advantest while rotating the roller as a measurement target in accordance with an aluminum cylinder having a diameter of 30 mm. Conditions of this measurement were 2 kV as an applied voltage, 30 seconds as an application time, 9.8 N as a contact pressure, and 190 mm/sec as a revolving circumferential velocity of the secondary transfer roller 10.

A description will now be given as to a path along which the recording material P is carried to the regions α and β. The recording material P carried by the pre-transfer carriage roller 18 is guided by the pre-transfer guide 17, and a leading end of the recording material P is thereby first brought into contact with the secondary transfer roller 10. Since the smoothness of the surface of the secondary transfer roller according to this embodiment is excellent as described above, the leading end of the recording material P is carried/guided to be slid on the surface of the secondary transfer roller 10, and then introduced into the first region α. According to this configuration, the recording material P can enter the first region α without coming into contact with the intermediate transfer belt 8. Additionally, the recording material P is carried to the second region β as a transfer nip portion while maintaining sufficient close contact properties with respect to the intermediate transfer belt 8 in the first region α as a nip portion immediately before transfer.

It is to be noted that, when the smoothness of the secondary transfer roller surface is poor, a leading edge of the recording material P is readily caught by the secondary transfer roller 10, behaviors of the leading end of the recording material P are disordered by a resistance at the time of contact of the recording material P with the secondary transfer roller 10, and the leading end of the recording material P comes into contact with toner images on the intermediate transfer belt 8 to distort an image. Therefore, as described above, the smoothness of the surface of the secondary transfer roller was assured, and the recording material immediately after contact of the recording material leading end with the secondary transfer roller 10 was set to stably enter the region α.

As mentioned above, it is possible to suppress the leading end portion of the recording material P from coming into contact with the toner images on the intermediate transfer belt 8 by the above-described behaviors before the leading end of the recording material P enters the first region α. This demonstrates an effect of restraining a given image deficit. This image deficit is generated when the leading end of the recording material P removes the toner images borne on the intermediate transfer belt 8. This is a phenomenon that the leading end portion of the recording material P comes into contact with the toner images on the intermediate transfer belt 8 to remove the toner image to be transferred before entering the nip region. This phenomenon produces two image deficits, i.e., an image deficit caused by removal of the toner images and an image deficit caused when the leading end of the recording material P is stained with the toner.

A mechanism of generation of the image deficits will now be described in more detail. According to such an image forming apparatus as described in the related art, the recording material is configured to first come into contact with the toner images on the intermediate transfer belt at a predetermined position oh the intermediate transfer belt. In this configuration, the image deficit is generated depending on settings of carriage speed control over the recording material or an approach angle of the recording material with respect to the intermediate transfer belt. This time, a description will be given as to an example where a position at which the recording material comes into contact with the intermediate transfer belt is shifted to an upstream side in a moving direction of the intermediate transfer belt as a comprehensible case.

The fact that the recording material comes into contact with the intermediate transfer belt on the upstream side in the moving direction means that the recording-material takes a detour from a path along which the recording material is essentially carried. When the recording material takes a detour to come into contact with the intermediate transfer belt, both the intermediate transfer belt and the recording material are moving, and hence the toner images on the intermediate transfer belt precede the recording material which has detoured. Then, the leading end of the recording material comes into contact with a rear side of the intermediate transfer belt in the moving direction apart from a position at which the leading end of the recording material is essentially brought into contact with the intermediate transfer belt. Further, when the leading end of the recording material moves to the transfer nip while being in contact with the secondary transfer belt, the leading end of the recording material removes the toner images on the intermediate transfer belt in a process where the intermediate transfer belt and the recording material reach the transfer nip. That is because a relative position of the recording material and the toner images on the intermediate transfer belt is set at a planned position and the roundabout path is eliminated when the transfer material reaches the transfer nip. That is, the recording material is in contact with the toner images on the intermediate transfer belt in a shifted manner, but an attitude of the recording material is corrected and the shift is gradually eliminated in the movement process, and the leading end of the recording material removes the toner images on the intermediate transfer belt in this process.

On the other hand, according to the image forming apparatus of this embodiment, since the leading end of the recording material P carried to be slid on the secondary transfer roller 10 is introduced into the region α without coming into contact with the intermediate transfer belt 8, the above-described image deficit is not produced. In particular, an effect of this configuration remarkably appears when toner images are formed to reach an edge of the recording material (when formation of an image having a small leading end margin or formation of an image having no margin (which will be also referred to as a "borderless image" hereinafter) is transferred onto the recording material P). That is because the toner images in the vicinity of the leading end of the recording material are not distorted in a transfer process. In the image forming apparatus according to this embodiment, toner images can be finely formed to reach an edge of the recording material P.

A carriage speed of the recording material P will now be described. In regard to a carriage speed of the recording material P, assuming that a carriage speed of the recording material P in the region β is 100%, the carriage speed of the recording material P by the pre-secondary-transfer carriage roller 18 is set to 101%. Based on this speed relationship, the following function can be demonstrated. When a given recording material P exists in the regions α and β and nipped by the secondary transfer carriage roller 18, a loop of the recording material P is slightly formed between the regions α and β and the secondary transfer carriage roller 18. Forming this loop can carry the recording material P which has entered the region α without being pulled by the pre-secondary-transfer carriage roller 18. This means that the recording material P which has entered the region α is stably carried with movement of the intermediate transfer belt 8 in a carriage process and a deviation can be suppressed from being generated between the recording material P and a position of the intermediate transfer belt 8 in the carriage process. That is, toner images are hard to deviate on the recording material P and further stable transfer can be realized.

Configurations of the regions α and β will now be described in detail.

A secondary transfer voltage of approximately 2 kV is applied to the cored bar of the secondary transfer roller 10 from a non-illustrated secondary transfer bias power supply through feeder springs. Furthermore, a cored bar of the secondary transfer opposed roller 15 is grounded, and a transfer electric field is formed between the secondary transfer roller 10 and the secondary transfer opposed roller 15. This transfer electric field is mainly formed in the region β shown in FIG. 1. As depicted in FIG. 1, the secondary transfer roller 10 is offset-arranged with respect to the secondary transfer opposed roller 15 on the upstream side in the belt moving direction. Moreover, the pre-secondary-transfer tension roller 13 is arranged on the upstream side in the belt moving direction apart from both the rollers 10 and 15. The arrangement of these rollers form the first region α and the second region β. The second region β is a region where both the secondary transfer roller 10 and the secondary transfer opposed roller 15 are in contact with front and rear sides of the intermediate transfer belt 8. The first region α is a nip region where the recording material P is nipped and carried by the intermediate transfer belt 8 and the secondary transfer roller 10 from the upstream side in the belt moving direction apart from the second region β. Providing this region α before the region β can suppress "toner scattering" or a "defect of transferring" due to discharge and improve a transfer quality of toner images in this embodiment. Since the intermediate transfer belt 8 and the recording material P are appressed against each other in the region α and the recording material P reaches the region β in the close contact state, the above-described "toner scattering" or "defect of transferring" can be suppressed, thereby maintaining a high image grade.

If the leading end of the recording material P is introduced into the transfer nip portion without obtaining sufficient close contact properties between the recording material P and the intermediate transfer belt 8, the so-called "toner scattering" or "defect of transferring" due to discharge occurs. The configuration of this embodiment suppresses them.

The "toner scattering" is a phenomenon that the toner in an image part (a part where the toner exists) of a toner image formed on the recording material P spreads. For example, it is a phenomenon resulting in an image having a blurry line of a character or the like.

A mechanism of this "toner scattering" will now be described. When the leading end of the recording material P is introduced into the transfer nip portion without obtaining sufficient close contact properties between the recording material P and the intermediate transfer belt 8, a transfer electric field is generated between the recording material P and the intermediate transfer belt 8 in a state where a gap exists between the recording material P and the intermediate transfer belt 8. The toner is going to move to the recording material P from the intermediate transfer belt 8 in accordance with the transfer electric field. Then, since the gap exists between the intermediate transfer belt 8 and the recording material P, the toner scatters between these members, namely, the toner moves along a long distance which is the gap, thereby resulting in unstable movement of the toner. Additionally, the toner has fixed electric charges, and there is a tendency that toners electrostatically repel each other. Therefore, existence of the gap produces a phenomenon that the toner spreads in the transfer process. This phenomenon leads to the "toner scattering".

The "defect of transferring" due to discharge means an image deficit due to discharge, and often involves a so-called discharge pattern. This pattern is apt to appear on a halftone image in particular.

A mechanism of the "defect of transferring" will now be described hereinafter. As described above, when the recording material P enters the transfer nip in a state where the intermediate transfer belt 8 and the recording material P are not appressed against each other, a transfer electric field is generated in the gap. When the transfer electric field in this gap portion exceeds a Paschen's law, discharge occurs in the gap portion, and a charge polarity of the toner in the vicinity of the gap is reversed. A polarity of the toner charged with a negative polarity is reversed to have a positive polarity. Then, the toner with the reversed charge moves in a direction opposite to a direction along which the toner essentially moves by the transfer process, and hence the toner does not reach the recording material P. Further, a part to which the toner does not move has no toner image, thus resulting in the "defect of transferring". This is the mechanism of forming the "defect of transferring" due to discharge.

According to the image forming apparatus of this embodiment, since the region α is provided and the recording material P reaches the region β in a state where the intermediate transfer belt 8 and the recording material P are appressed against each other, the above-described "toner scattering" and "defect of transferring" can be suppressed, thereby maintaining a high image grade.

It is to be noted that there is the relationship that the carriage speed of the recording material P by the pre-secondary-transfer carriage roller 18 is higher than the carriage speed of the recording material P in the region β, and hence the recording material P which has reached the region α is carried without being pulled by the pre-secondary-transfer carriage roller 18. Furthermore, movement of the recording material P at the time of transfer can be stabilized in the entire region of the recording material, and the close contact state of the recording material P and the intermediate transfer belt 8 can be maintained, thereby suppressing the "toner scattering" and the "defect of transferring" in the entire region of the recording material.

Second Embodiment

An image forming apparatus according to a second embodiment will now be described. It is to be noted that an outline structure of the entire image forming apparatus is substantially the same as that in the foregoing embodiment, and hence a description will be given on a structure different from the first embodiment. The structure having the elastic member consisting of the three-layered configuration on the cored bar as the secondary transfer roller formed of two or more layers has been described in the first embodiment, but a description will be given as to an example where the secondary transfer roller has a two-layered configuration in the second embodiment. A configuration and a material of the secondary transfer roller will now be described.

Figure 4B:
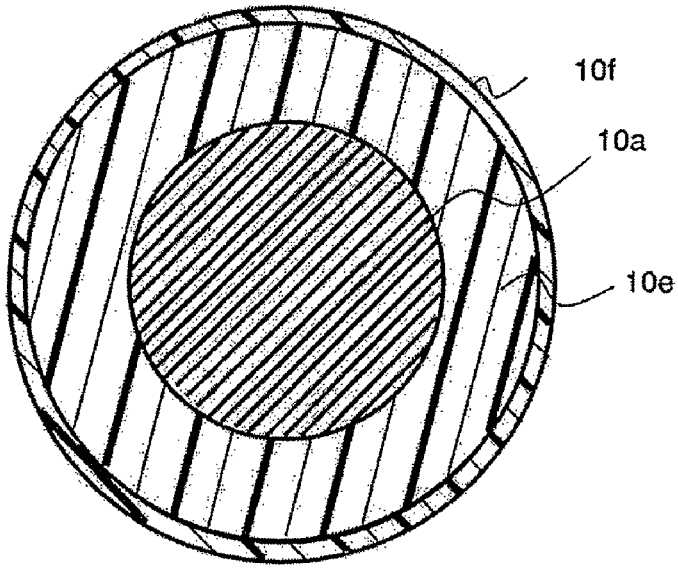

As shown in FIG. 4B, the secondary transfer roller according to this embodiment has a two-layered configuration, and a layer other than a surface layer is an elastic member whose hardness is not greater than 45° in terms of the Asker-C hardness. Specifically, in the secondary transfer layer having the two-layered configuration, a base layer 10*e* is foamed rubber (the elastic member) on the cored bar 10*a*, the rubber consisting of blended rubber in which epichlorohydrin and acrylonitrile-butadiene rubber (NBR) are blended, and a degree of hardness of the base layer portion (a degree of hardness of the base layer +a cored bar) is 30° in terms of the Asker-C hardness under a load of 500 g or below.

Moreover, the surface layer 10*f* is formed of a resin tube on the base layer 10*e*. The foamed rubber is covered with the tube. The resin tube forming the surface layer of this secondary transfer roller is a resin tube having a thickness of 70 μm. In this embodiment, as the resin tube forming the surface layer, a resin having high smoothness with respect to a recording material is selected. Specifically, as the resin tube forming the surface layer, polyvinylidene fluoride (PVDF) subjected to resistance adjustment by carbon black is used. However, the present invention is not restricted thereto. For example, the resin tube may be a tube using other resins such as polyimide, polycarbonate, polyester, polypropylene or polyethylene terephthalate.

When the resin tube having high smoothness of the surface was used for coating in this manner, a contact angle (a contact angle of pure water) of the secondary transfer roller according to this embodiment on a roller surface thereof became 70°.

The resin tube forming the surface layer of the secondary transfer roller covers the foamed rubber of the base layer in a compressively deformed state. The resin tube is fixed between the base layer and the surface layer by a fastening force. If a deviation or the like occurs between the surface layer and the base layer, a bonding layer may be provided.

In case of the secondary transfer roller in which the surface layer is covered with the resin tube, there is a fear that a degree of hardness of the roller surface becomes too high. In case of using the secondary transfer roller, when a degree of hardness is too high, there is a problem that transfer properties or carriage properties of the recording material are not stabilized. According to a result of an experiment conducted by the present inventor, it is desirable to set a degree of hardness of the secondary transfer roller to 45° or below in order to obtain a stable nip in a secondary transfer portion or stable recording material carriage properties.

Thus, the present inventor set a thickness of the resin tube which covers the foamed rubber having the Asker-C hardness of 30° under a load of 500 g to 70 μm so that the Asker-C hardness of the secondary transfer roller become 37°.

It is to be noted that a degree of hardness was measured in structures coated with PVDF resin tubes having different thicknesses. When a thickness [μm] of each resin tube was set to 30, 70, 150 or 250, the Asker-C hardness as the entire roller was 34, 37, 45 or 49.

As described above, selecting a resin having high smoothness of a surface for the resin tube of the surface layer can obtain the same effect as that in the first embodiment, thereby acquiring an excellent image.

Third Embodiment

Figure 5:
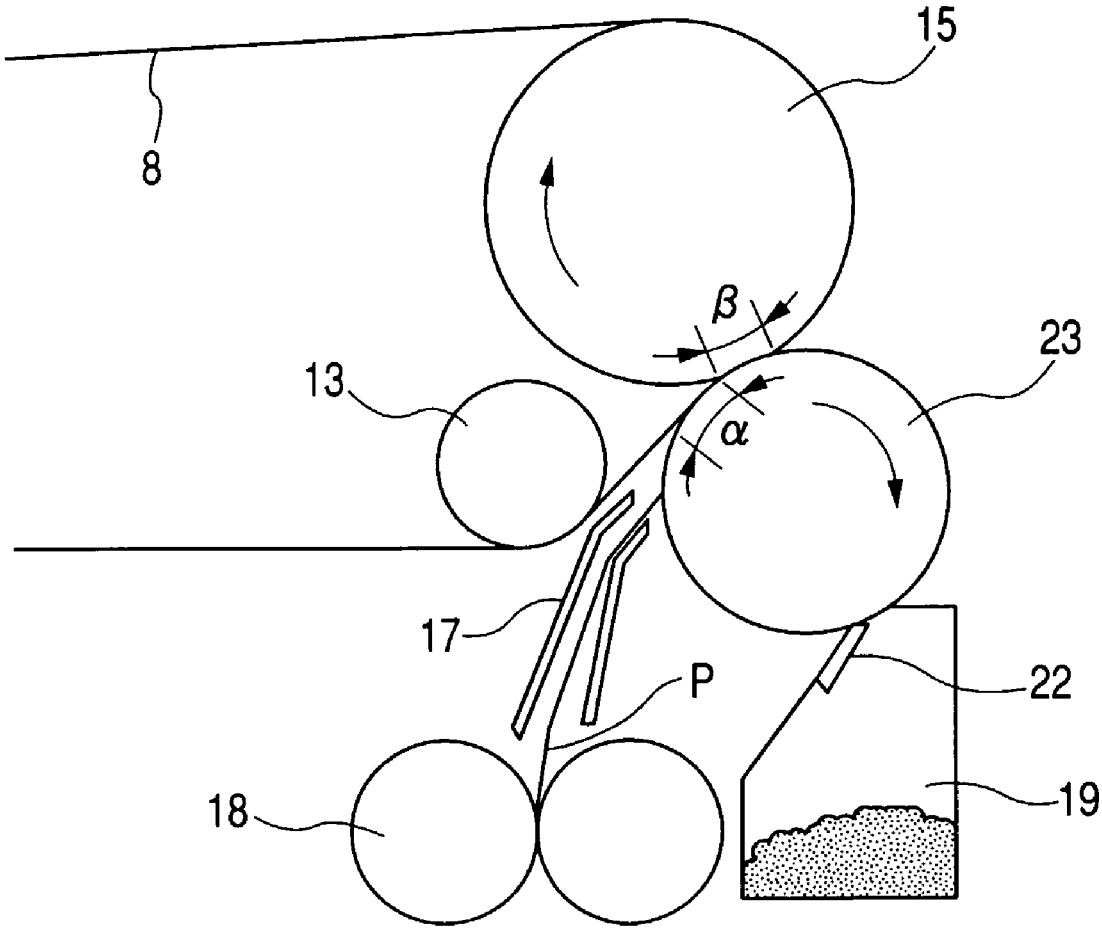
FIG. 5 shows an outline configuration of a secondary transfer portion of the image forming apparatus according to the third embodiment.

An image forming apparatus according to a third embodiment will now be described with reference to FIG. 5. FIG. 5 is a cross-sectional view showing a configuration around a secondary transfer portion. It is to be noted that an outline structure of the entire image forming apparatus is substantially the same as those of the foregoing embodiments, and hence a description will be given as to a configuration different from that in the first embodiment.

The image forming apparatus according to this embodiment has a "borderless image forming mode" which is a mode of forming a toner image without a margin on a recording material P.

In the image forming apparatus according to this embodiment, a toner image which is 3 mm larger than a size of the recording material in front-to-back and left-to-right directions was formed on an intermediate transfer belt 8 in such a manner that the toner image can be formed to reach an edge of the recording material P even in a state where a carriage timing of the recording material P is shifted. Therefore, a toner which cannot be transferred onto the recording material P from the intermediate transfer belt 8 at the time of secondary transfer and thereby runs off is directly transferred onto a secondary transfer roller 23.

Thus, this embodiment has a transferring member cleaning member which removes the toner which has adhered to the secondary transfer roller 23. Specifically, as shown in FIG. 5, there is provided a cleaning blade 22 as the transferring member cleaning member which comes into contact with the secondary transfer roller 23 to remove the toner. This cleaning blade 22 is formed of urethane rubber, and it is in contact with the secondary transfer roller 23 within a line pressure range of 20 to 100 g/cm. Further, the toner removed by the cleaning blade 22 is configured to be stored in a wasted toner container 19.

It is to be noted that the secondary transfer roller 23 according to this embodiment is superior in smoothness like the secondary transfer roller 10 according to the first embodiment, and hence removal of the toner is easy. Therefore, a surface of the secondary transfer roller 23 has high cleanability. In a production process of the secondary transfer roller 23, foaming is effected in a cylindrical container to shape an elastic layer. At the time of shaping, a so-called a skin layer is eventually formed at a position where contact is made with respect to the cylindrical container, thereby obtaining a roller having a surface on which foamed cells do not appear.

Furthermore, as a result of an experiment conducted by the present inventor, when a contact angle of the secondary transfer roller surface was maintained at 70° or above, stable cleaning with less adherence of water was realized even in a high-humidity environment. That is because catching of the cleaning blade 22 and the secondary transfer roller 23 was able to be suppressed.

Moreover, in this embodiment, average roughness Rz of the surface of the secondary transfer roller 23 on a scale of one to ten is set to 3 μm. That is because setting Rz to be smaller than a toner particle diameter can more assuredly clean the toner. This prevents the toner from slipping through the cleaning blade 22 to be result in a cleaning defect.

As described above, according to this embodiment, in case of recording an image having no margin on the recording material by forming the image larger than a size of the recording material on the intermediate transfer belt, the secondary transfer roller 23 can be cleaned, and the same effect as that in the first embodiment can be obtained.

It is to be noted that the cleaning member of the secondary transfer roller 23 is the blade in this embodiment, but the present invention is not restricted thereto, and it is possible to adopt other physical cleaning members such as a brush or a web or electrostatic cleaning members which brings a cleaning roller or the like to which a bias power can be applied into contact with the secondary transfer roller to collect the toner.

Although the four image forming portions are used in order to form a color image in the foregoing embodiments, the image forming portions to be used are not restricted to this number, and the number may be appropriately set as required. Moreover, the present invention is not restricted to the color image forming apparatus, and it may be an image forming apparatus which forms a monochromatic image.

Additionally, although the printer has been exemplified as the image forming apparatus in the foregoing embodiments, the present invention is not restricted thereto, it may be, e.g., other image forming apparatuses such as a copying machine or a facsimile device or other image forming apparatuses such as a complex machine in which functions of these devices are combined, and applying the present invention to the image forming apparatus can obtain the same effect.

Further, although the various embodiments according to the present invention have been described, aims and scopes of the present invention are not restricted to specific descriptions and drawings in this specification. For example, it is needless to say that the present invention can be applied to a case where transfer is directly performed onto a recording material from a photosensitive member.

This application claims priority from Japanese Patent Application No. 2005-126454 filed on Apr. 25, 2005, which is hereby, incorporated by reference herein.

The invention claimed is:

1. An image forming apparatus comprising:

an endless belt which bears a toner image on an outer surface of the endless belt;

a transferring member which forms a nip with the endless belt and transfers the toner image from the endless belt onto a recording material which enters the nip; and a transfer opposed member which contacts an inner surface of the endless belt and opposes the transferring member through the endless belt, wherein the image forming apparatus is operable in a borderless image forming mode in which a toner image is formed to edges of the recording material by forming a toner image larger than a size of the recording material on the endless belt, and transferring a part of the toner image on the endless belt onto the recording material, wherein in a case where a toner image is formed on the endless belt by the borderless image forming mode, a toner image on the endless belt enters the nip before a leading edge of the recording material enters the nip, wherein the transferring member is provided to form a first area that pinches the endless belt with the transfer opposed member, and a second area that contacts the outer surface of the endless belt upstream of the first area in a conveyance direction of the recording material without pinching the endless belt with the transfer opposed member, and wherein the image forming apparatus further comprises:

a guide member which guides a leading edge of the recording material to contact a surface of the transferring member upstream of the second area in the conveyance direction of the recording material, wherein the transferring member has a foamed layer and a cover layer, and the cover layer is not foamed and forms the surface of the transferring member.

2. An image forming apparatus according to claim 1, wherein the leading edge of the recording material enters the second area without coming into contact with the endless belt in advance.

3. An image forming apparatus according to claim 1, wherein the cover layer is a resin tube.

4. An image forming apparatus according to claim 1, wherein the surface of the transferring member is a coated surface, and wherein the cover layer is coated with a fluorine compound to form the coated surface.

5. An image forming apparatus according to claim 1, wherein a degree of Asker-C hardness of the transferring member is not greater than 45 degrees.

6. An image forming apparatus according to claim 1, wherein the transferring member is a roller configured to carry the recording material.

7. An image forming apparatus according to claim 6, further comprising:

a carriage member which carries the recording material to the guide member, wherein a speed of recording material handling by the carriage member is higher than a speed of recording material handling by the transferring member.

8. An image forming apparatus according to claim 1, further comprising:

a cleaning member which comes into contact with the transferring member, wherein the cleaning member removes toner, which has adhered to the transferring member, from the transferring member.

9. An image forming apparatus according to claim 1, further comprising a photosensitive member which bears a toner image, wherein the endless belt is an intermediate transferring member onto which the toner image is transferred from the photosensitive member.

10. An image forming apparatus according to claim 1, wherein the cover layer is coated with a siloxane compound.

11. An image forming apparatus according to claim 10, wherein the leading edge of the recording material initially advances toward the nip without coming into contact with the endless belt.

12. An image forming apparatus according to claim 10, further comprising:

a photosensitive member which bears a toner image, wherein the endless belt is an intermediate transferring member which receives transfer of the toner image from said photosensitive member.

13. An image forming apparatus according to claim 10, further comprising:

a cleaning member which comes into contact with said transferring member, wherein said cleaning member removes toner, which has adhered to said transferring member, from said transferring member.

14. An image forming apparatus according to claim 1, wherein the cover layer is a surface layer of said transferring member, and a contact angle on the cover layer is equal to or more than 60 degrees in a condition where 3 milliliters of pure water is dropped on the cover layer.

* * * * *